US005433654A

United States Patent [19]

Clark, Jr. et al.

[11] Patent Number: 5,433,654

[45] Date of Patent: Jul. 18, 1995

[54] PRESSURIZED FERROFLUID PAINT REMOVAL SYSTEM USING AN ELECTROMAGNET AND EDDY CURRENT ENCIRCLING COIL TO ADJUST WEIGHT PERCENTAGE OF MAGNETIC PARTICLES

[75] Inventors: William G. Clark, Jr., Murrysville; John J. Herald, Monroeville, both of Pa.; Peter K. Liaw, Knoxville, Tenn.

[73] Assignee: Westinghouse Electric Corp., Pittsburgh, Pa.

[21] Appl. No.: 69,500

[22] Filed: Jun. 1, 1993

[51] Int. Cl.[6] ..... B24C 5/04; B24C 3/12

[52] U.S. Cl. ..... 451/40; 451/38; 451/2; 451/90; 451/93

[58] Field of Search ..... 51/319, 320, 321, 410, 51/415, 427, 428, 430; 451/38, 39, 40, 75, 2, 90, 91, 93

[56] References Cited

U.S. PATENT DOCUMENTS

| | | | |
|---|---|---|---|
| 3,483,969 | 12/1969 | Rosenweig . | |
| 3,581,492 | 6/1971 | Destics | 51/9 |
| 3,915,880 | 10/1975 | Sepulveda | 252/99 |
| 4,330,968 | 5/1982 | Kobayashi et al. | 51/425 |
| 4,554,025 | 11/1985 | Burke et al. | 134/17 |
| 4,702,786 | 10/1987 | Tallman | 156/159 |
| 4,773,189 | 9/1988 | MacMillan et al. | 51/425 |
| 4,827,678 | 5/1989 | MacMillan et al. | 51/320 |
| 4,836,858 | 6/1989 | Reinhart | 51/285 |
| 4,858,264 | 8/1989 | Reinhart | 15/93 R |
| 4,944,185 | 7/1990 | Clark, Jr. et al. | 73/579 |
| 5,044,129 | 9/1991 | Olevitch | 51/322 |
| 5,092,084 | 3/1992 | Schlick | 51/432 |

OTHER PUBLICATIONS

Georgia Pacific, "Lignosite Product Information Sheet", undated.

Georgia Pacific Technical Bulletin, "Lignosite FML", Mar. 1980.

Ferrofluidics Corporation, "Ferrofluids—Physical Properties and Applications," 1986.

Ferrofluidics Corporation advertisement, undated.

*Primary Examiner*—Bruce M. Kisliuk
*Assistant Examiner*—Eileen P. Morgan
*Attorney, Agent, or Firm*—Christopher O. Edwards

[57] ABSTRACT

A process for removing paint by high pressure waterjet blasting of painted surfaces wherein the waterjet comprises a ferrofluid or other liquid containing tiny magnetic particles suspended therein. The particles may be in colloidal suspension or be suspended by agitation and are preferably polymer coated. The liquid-magnetic particle mixture lends itself to electromagnetic process control, run-off maintenance and waste processing capabilities. Thereby, the process can employ process control and waste remediation options.

14 Claims, 3 Drawing Sheets

PRESSURIZED FERROFLUID PAINT REMOVAL SYSTEM USING AN ELECTROMAGNET AND EDDY CURRENT ENCIRCLING COIL TO ADJUST WEIGHT PERCENTAGE OF MAGNETIC PARTICLES

BACKGROUND OF THE INVENTION

1. Field of the Invention

The invention relates generally to a method for the removal of paint from metal surfaces, such as aircraft surfaces, and more particularly to a paint removal method that involves directing a pressurized stream of a ceramic particle/liquid mixture upon the painted surface.

2. Description of the Prior Art

The removal of paint from aircraft surfaces is an important, periodic operation associated with both inspection and maintenance procedures on military and commercial equipment. The paint is removed both to enhance the inspection of underlying metal and composite surfaces as well as part of the routine maintenance associated with degrading paint quality.

Until recently, chemical paint removal options were more or less standard practice. With the growing concern for environmental quality and waste remediation and control, the casual use and disposal of paint removing chemicals is no longer acceptable. Consequently, thermal and mechanical removal methods which minimize environmental impact and permit collection of waste products have come under consideration.

Paint removal means have included directing solid abrasive particles in an air jet toward the painted surface as disclosed in U.S. Pat. No. 5,092,084 to Schlick. A problem associated with this type of paint removal method lies in the collection of the abrasives and the separated paint. Painstaking collection means are typically employed which could involve running the contaminated abrasives through separators and screens. An example of such a collection scheme is disclosed in U.S. Pat. No. 4,773,189 to MacMillan et al. Aside from drawbacks in the collection of the contaminated abrasive materials, these types of paint removal methods create a large amount of dust and generate heat on the painted surface that may result in thermal degradation.

Waterjet and water plus abrasive hydrojet options are particularly attractive for automated large surface area paint stripping considerations because the presence of water serves to minimize dust, cool the surface (to prevent thermal degradation), and assist in the collection of waste product (depainting residue). In addition, cutting versions of these systems are already widely used in a variety of industries.

Despite proven deployment concepts and significant environmental advantages, hydrojet techniques involve very high localized energy levels which could affect material properties (redistribute favorable residual stresses, distort fastener hole alignment, etc.). In addition, without a good water collection system, waste product collection can be difficult and effective disposal options nil. Also, conventional hydrojet systems do not offer an option (excluding on/off control) for adjusting the amount of abrasive in the water stream.

Clearly, a system which can be adjusted to efficiently remove paint from multiple layers yet not impact the underlying surface is required as well as a waste product collection system which can effectively and reliably collect and sort virtually all paint residue for subsequent disposal.

SUMMARY OF THE INVENTION

We provide a process for removing paint by high pressure waterjet blasting of painted surfaces wherein the waterjet comprises a ferrofluid or other liquid containing tiny magnetic particles, preferably iron oxide, suspended therein. The particles may be in colloidal suspension or be suspended by agitation and are preferably polymer coated.

The ferrofluid is fed from a feed line to where it mixes with pressurized water. The pressurized mixture having the magnetic particles suspended therein is then directed out of a nozzle toward the painted surface.

The liquid/magnetic particle mixture lends itself to electromagnetic process control. The process controls include density monitoring such as providing the nozzle with an eddy current encircling coil. The encircling coil detects the amount of magnetic particles passing through the nozzle as an impedance change. Also, electromagnetic process control may be used as a density control means to control the amount of magnetic particles in the mixture. Density control may be accomplished by providing the feed line with an electromagnet. The feed line electromagnet can be energized to selected levels causing a selectable amount of magnetic particles to be drawn into the feed line. Additionally, ferromagnetic filtering means may be employed to separate the magnetic particles from their contaminants after the paint removal operation has been performed. Thereby, the disclosed paint removal system offers the advantages of employing electromagnetic process control and waste remediation means.

Other objects and advantages of the invention will become apparent from a description of certain present preferred embodiments thereof shown in the drawings.

DETAILED DESCRIPTION OF THE PREFERRED EMBODIMENT

The ferrofluid paint removal system involves a mixture of water containing small amounts of magnetic particles suspended therein. The mixture is directed in a pressurized spray at up to around 60,000 psi to the surface of interest to remove paint by virtue of a wet "sand" blasting operation. The magnetic particles act as an abrasive in removing paint from the surface.

Commercially available ferrofluid 35 (represented in exaggerated scale in FIG. 1) is a magnetic liquid which consists of an aqueous colloidal suspension (about 30% solid) of tiny (around 50–200 Angstroms) ferrite particles 40 that will be mixed with the water to produce an optimum mixture formulation (liquid to solid particle ratio) for paint removal. Ferrite is a non-conductive, ferrous-based ceramic material. An example of a suitable aqueous ferrite colloid is Lignosite FML, CAS Registry Number 39331-38-9, which is the iron salt of lignosulfonic acid, manufactured by the Georgia-Pacific Corporation. Although the term "ferrofluid" is used throughout this description to describe the composition of the paint removing mixture, it is understood that particles of any magnetic material such as nickel oxide may be suspended in the liquid to produce the paint removing mixture.

A hydrojet system such as the kind typically used for cutting can be modified to deliver the mixture. The cutting nozzle of a waterjet cutting system would be replaced with a blasting nozzle and the pressure reduced to address paint removal. To modify a hydrojet system for use in ferrofluid paint removal, a ferrofluid feed would be incorporated as well.

Figure 1:
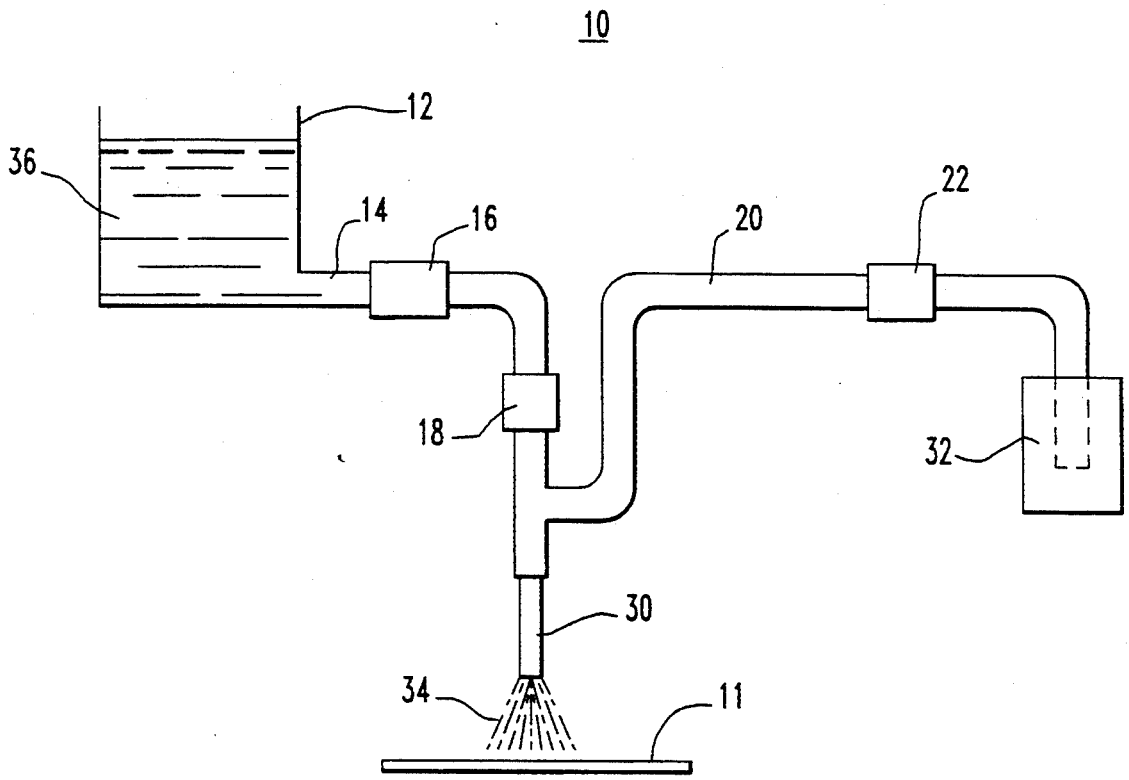
FIG. 1 is a schematic of a preferred ferrofluid paint removal system.

FIG. 1 shows a system 10 that may be utilized in a ferrofluid paint removal operation for removing paint or some other coating from a surface 11. The preferred hydrojet system 10 for delivering the mixture 34 has a delivery line 14 which draws water 36 from a water source 12. Along delivery line 14 is an intensifier 16 which pressurizes the water 36 drawn from the water source 12. The intensifier 16 may include a booster pump and/or a hydraulic drive unit. The pressurized water 36 is then carried in the delivery line 14 to an on/off valve 18. Once passing through the on/off valve 18, the pressurized water 36 is mixed with the ferrofluid 38 before existing out of nozzle 30. Although water is the preferred carrier fluid from the pressurized jet, any suitable liquid may be used.

A feed tube 20 draws the ferrofluid 38 from a ferrofluid reservoir 32. A pump 22 draws the ferrofluid 38 from the ferrofluid reservoir 32 through feed tube 20 to mix with the water 36 in delivery line 14. The end of the feed tube 20 which is disposed in the fluid reservoir 32 is preferably equipped with an electromagnet 24. The electromagnet 24 acts as a density control means for controlling the density of magnetic particles in the mixture 34 as will be described in more detail below.

Delivery line 14 is equipped with a nozzle 30 out of which the pressurized mixture exits the line delivery 14. The density monitoring system 28 monitors the density of magnetic particles 40 in the mixture 34 exiting the nozzle 30. In this way, a pressurized stream of liquid 34 having magnetic particles 40 suspended therein may exit the nozzle 30 and be directed toward a painted surface 11. The nozzle 30 is preferably equipped with a density monitoring system 28 which involves placing an eddy current encircling coil 29 around the nozzle.

Figure 2:
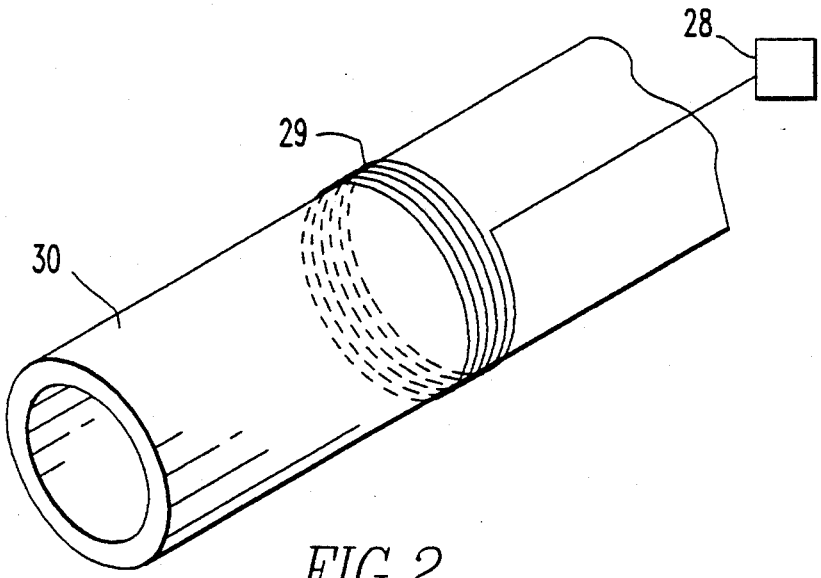
FIG. 2 is a perspective view of an encircling coil eddy current sensor for use with the delivery of the mixture.
Figure 3:
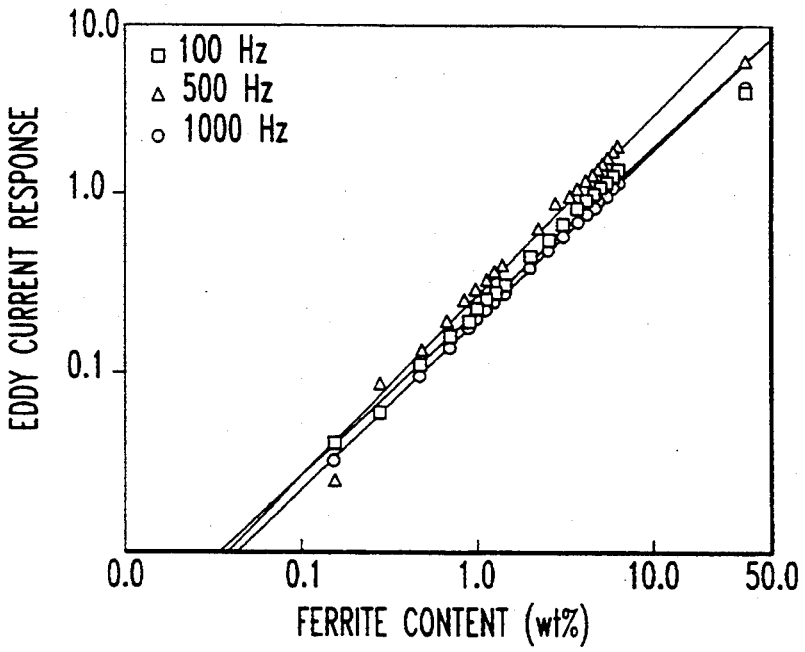
FIG. 3 is a diagrammatic plot of eddy current response versus ferrite content in the mixture.

Process control to provide on-line selection of both the ferrofluid formulation and water pressure would provide the process control variables necessary to adjust the "blast" energy applied to the paint surface of concern. The magnetic properties of the ferrofluid 38 provide relatively easy and interactive control and monitoring of the mixture formulation. Specifically, the electromagnetic (magnetic permeability) signature of the ferrofluid 38 is a direct measure of the amount of ferromagnetic particles 40 in the aqueous colloidal suspension. This signature can be measured with a simple encircling coil eddy current sensor 29 surrounding the feed line 20 or preferably the nozzle 30 of the hydrojet system 10. For this reason, the nozzle 30 or portion of feedline 20 surrounded by the encircling coil sensor 29 should preferably be made of a nonmagnetic material, such as ceramic or plastic. A simple encircling coil sensor 29 is illustrated in FIG. 2. FIG. 3 illustrates the sensitivity of eddy current response to the amount of ferrite particles 40 in water. The eddy current response is typically measured by providing an AC field to energize the encircling coil 29, creating an impedance that may be measured. As magnetic material is proximate the encircling coil 29, the impedance changes at the encircling coil 29 and this impedance change may be measured. Therefore, the density of magnetic particles 40 in the mixture 34 passing through the feed line 20 or exiting the nozzle 30 may be monitored.

Figure 4:
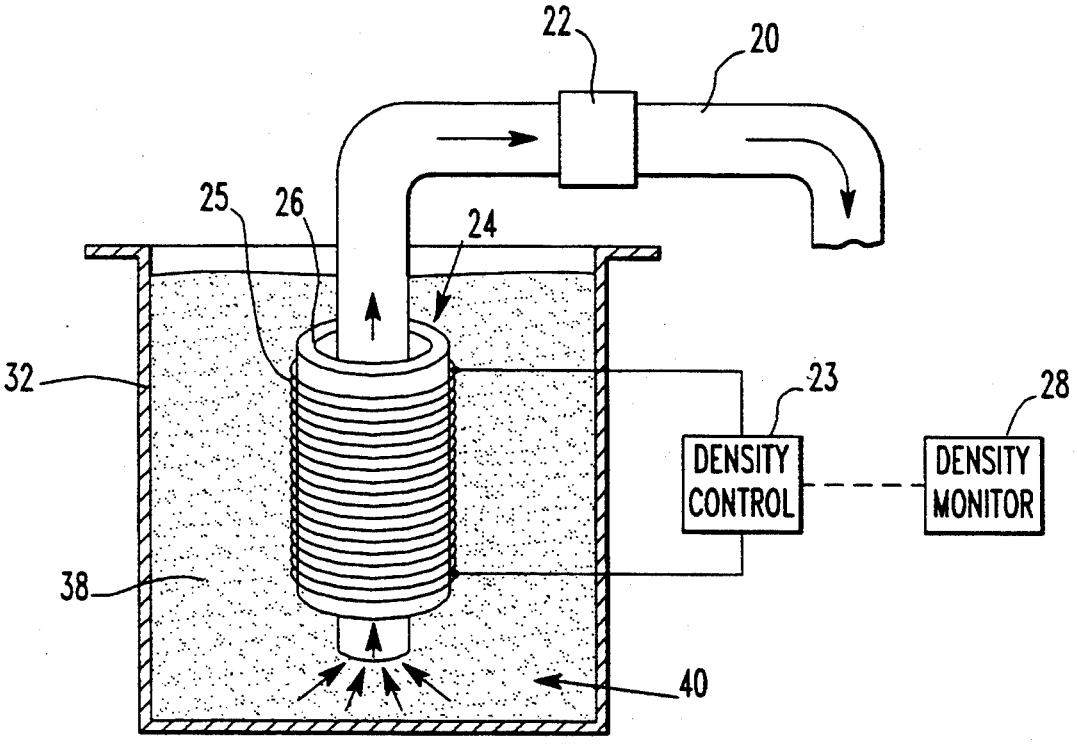
FIG. 4 is a schematic representation of an electromagnetic means for controlling the density of magnetic particles in the mixture.

Referring next to FIG. 4, on-line adjustment may be made of the density of the magnetic particles 40 in the ferrofluid 38 to be mixed with the water 36. Thus, the optimum formulation for paint removal in a given system can be controlled by using the magnetic properties of the ferrofluid 38. Specifically, since a magnetic field can control the density (the amount of magnetic particles 40)) of the ferrofluid 38, an electromagnet 24 on the feed tube 20 could be used as a density control 23 to precisely control the amount of solid, magnetic particles 40 in the waterjet spray of mixture 34. The electromagnet 24 may simply be an encircling coil 25 that is energized by an AC field or it may be an encircling coil 25 that surrounds a core 26 made of soft iron or any other suitable low reluctance material. The magnitude of the AC field that energizes the electromagnet 24 is selectable so that the intensity of the magnetic field generated is selectable as well. The greater the magnetic field created at the electromagnet 24, the greater the amount of magnetic particles 40 drawn into the feed tube 20. Thus, by adjusting the magnitude of the magnetic field at the electromagnet 24, the density of the ferrofluid 38 that is mixed with the pressured water 36, as well as the density of the final mixture 34 may be adjusted.

Communication between the particle sensor encircling coil 29 and the variable field electromagnet 24 provides a feedback system for particle control. In this way, the desired density of the mixture 34 may be input at the electromagnet 24 as the field intensity. The actual density of the mixture 34 is detected as the mixture exits the nozzle 30. If the actual density of the mixture is different from the desired density, the field intensity of the electromagnet 24 would be adjusted using a simple, well known feedback circuit. For example, depending on the paint system, an exact combination of magnetic particles 40 and water pressure can be selected to optimize paint removal. The stripping parameters could be controlled to address different kinds of paint, different number of paint layers and for different surface materials.

The magnetic properties of the ferrofluid 38 can be used to enhance traceability and fluid collection. In the case of paint removal where it is important to monitor and collect the waste product, the availability of a magnetic carrier fluid 34 can be a significant advantage. Specifically, magnetic devices could be used to detect, dam, direct, and collect the ferromagnetic carrier fluid containing the waste residue. These applications would minimize fluid control considerations.

Paint particles collected in the ferrofluid blast water run-off would become attached to the tiny magnetic particles 40 and, consequently, could be removed from the blast water run-off by magnetic means. The waste solution can be passed to a reservoir with a permanent magnet immersed in it. The magnet will attract the magnetic particles 40 having paint adhered thereto, leaving water for recycle. Then, the magnetic particles 40 can be separated from the paint particles, by any suitable method. Once entrapped in the mixture 34, electromagnetic filtering could be used to sort waste product by density so that separating residue from different kinds of paint could be an option. Such ferromagnetic filtering is disclosed in U.S. Pat. No. 3,483,969 to Rosenweig. Note that any mixture 34 that might escape the magnetic collection system could easily be detected by an electromagnetic device (such as the encircling coil shown in FIG. 3) placed at drainage areas, thus providing further environmental monitoring and protection.

The particles 40 in the liquid jet mixture 34 are magnetic and are preferably coated with a stabilizing dispersing agent such as a suitable polymer material. The coating also acts as a lubricant for prevention of scoring or otherwise injuring the metal surface beneath the coating of paint being removed. The solid particles 40 must be in a suspended condition in the liquid. They can be in colloidal suspension or may be non-colloidal and maintained in suspension by agitation.

The size and hardness of the suspended magnetic particles 40 are both important. The suspended particles can be 50 Angstroms in diameter, and higher. The particles in the jet can comprise from 0.01 weight percent solids, and higher. If desired, a jet of dry particles can be employed (100 percent solids), but a colloid or suspension is preferred. The optimum concentration is about 5 weight percent solids. The preferable range is 1 to 10 weight percent solids. The preferred range for the hardness of the particles 40 is about 6–8, MOHS value.

The pressure of the jet of the mixture 34 will be high enough to chip the paint particles off the surface 11 without eroding or damaging an underlying metal surface. Pressures up to 50,000 psi can be employed. Individual solid particles 40 in the jet will chip off paint particles of about the same size as the magnetic particle. Thereby, paint existing in a layer is removed in particle form and the paint particles are attracted to and adhere to the magnetic particles 40 and go into solution in the mixture run-off stream. If desired, the run-off stream can be deionized for product recovery. The deionization can remove metals, such as lead, present in paints.

The flow rate and pressure of the hydrojet can be controlled to remove the paint without cutting into metal, such as without cutting into the surface of an aircraft. The method can regulate various parameters. For example, fluid density and flow volume can be regulated if it is desired to reduce water pressure.

As stated above, the ferrites or other particles have a polymer coating which acts as a lubricant so that the particles will cut paint but not underlying metals. Waxy-like organic polymers are suitable. A useful coating is lignasulfate.

While certain present preferred embodiments have been shown and described, it is distinctly understood that the invention is not limited thereto but may be otherwise embodied within the scope of the following claims.

We claim:

1. A method of removing paint from a surface, comprising the steps of:

(a) providing a mixture comprised of a liquid having a selected weight percentage of magnetic particles suspended therein, wherein the magnetic particles are in colloidal suspension in the liquid;

(b) directing the mixture in a pressurized stream toward the painted surface;

(c) monitoring the weight percentage of the magnetic particles in the mixture delivered toward the surface by delivering the mixture through an eddy current encircling coil; and (d) adjusting the weight percentage of the magnetic particles by drawing a ferrofluid from a reservoir through an electromagnetic field created by an electromagnet, the magnitude of the electromagnetic field being adjustible and controlled by a feedback control circuit connected to the eddy current encircling coil.

2. The method of claim 1 wherein the magnetic particles are at least one of iron oxide and nickel oxide.

3. The method of claim 1 wherein the particles have a width of between 50 and 200 Angstroms.

4. The method of claim 1 wherein the liquid is water.

5. The method of claim 1 wherein the mixture is about 5% by weight solid.

6. The method of claim 1 wherein the magnetic particles are coated with a polymer.

7. The method of claim 6 wherein the polymer is lignasulfate.

8. The method of claim 1 further comprising the step of selectively adjusting the weight percentage of the magnetic particles in the mixture.

9. The method of claim 8 wherein the weight percentage of the magnetic particles in the mixture is adjustable by drawing a ferrofluid from a reservoir through an electromagnetic field created by an electromagnet, the magnitude of the electromagnetic field being adjustable.

10. The method of claim 9 further comprising the step of mixing the ferrofluid with a pressurized carrier fluid.

11. The method of claim 1 further comprising the step of collecting mixture run-off by magnetically filtering the run-off.

12. The method of claim 11 further comprising the step of removing the magnetic particles and paint residue provided thereon from the mixture runoff by magnetic separation.

13. A system for removing paint from a surface, comprising:

(a) a liquid source holding a carrier liquid therein;

(b) a delivery line, one end of the delivery line being connected to the liquid source and an opposite end of the delivery line having a nozzle for directing liquid therefrom;

(c) an intensifier for pressurizing the carrier liquid drawn from the liquid source;

(d) a feed line for feeding a fluid having magnetic particles suspended therein into the delivery line, the feed line being engaged at one end to a fluid reservoir for holding the fluid with magnetic particles suspended therein and being connected at an opposite end to the delivery line;

(e) an electromagnet for creating an electromagnetic field provided at the end of the feed line engaged with the reservoir, wherein the electromagnet may be energized so as to draw a selected amount of magnetic particles into the fluid drawn into the feed line;

(f) an eddy current encircling coil provided around the nozzle, the encircling coil detecting an impedance change dependent upon the the amount of magnetic particles present in the mixture exciting the nozzle; and (g) a feedback control circuit connected to the eddy current encircling coil for adjusting and controlling the magnitude of the electromagnetic field.

14. The system for removing paint of claim 13 wherein the carrier liquid is water and the magnetic particles are iron oxide.

* * * * *